US007775283B2

(12) United States Patent
Coronado et al.

(10) Patent No.: US 7,775,283 B2
(45) Date of Patent: Aug. 17, 2010

(54) VALVE FOR EQUALIZER SAND SCREENS

(75) Inventors: Martin P. Coronado, Cypress, TX (US); Brad R. Pickle, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 710 days.

(21) Appl. No.: 11/598,508

(22) Filed: Nov. 13, 2006

(65) Prior Publication Data

US 2008/0135255 A1 Jun. 12, 2008

(51) Int. Cl.
*E21B 34/06* (2006.01)

(52) U.S. Cl. ..... 166/323; 166/66.5; 166/324; 137/624.27

(58) Field of Classification Search ..... 166/66.5, 166/323, 324; 137/624.27, 517
See application file for complete search history.

(56) References Cited

U.S. PATENT DOCUMENTS

| | | | | |
|---|---|---|---|---|
| 2,707,997 | A | 5/1955 | Zandmer et al. | |
| 2,708,000 | A | 5/1955 | Zandmer | |
| 2,775,304 | A | 12/1956 | Zandmer | |
| 2,855,049 | A | 10/1958 | Zandmer | |
| 3,245,472 | A | 4/1966 | Zandmer | |
| 3,326,291 | A | 6/1967 | Zandmer | |
| 3,347,317 | A | 10/1967 | Zandmer | |
| 3,382,926 | A | 5/1968 | Zandmer | |
| 3,434,537 | A | 3/1969 | Zandmer | |
| 4,285,398 | A | 8/1981 | Zandmer et al. | |
| 5,375,662 | A * | 12/1994 | Echols et al. | 166/386 |
| 5,425,424 | A | 6/1995 | Reinhardt et al. | |
| 6,220,357 | B1 | 4/2001 | Carmichael et al. | |
| 2005/0126787 | A1 * | 6/2005 | Gomez | 166/323 |
| 2005/0199399 | A1 * | 9/2005 | Hayter et al. | 166/334.1 |

OTHER PUBLICATIONS

Baker Oil Tools, Equalizer Screen, Product Information, date unknown, 1 page.

Kelbie, G.M., et al.; Isolating Unwanted Water Production: The Through-Tubing Inflatable Solution; SPE 102881, Aug. 2006, 1-8.

Mackenzie, Gordon, et al., "Wellbore Isolation Intervention Devices Utilizing a Metal-to-Metal Rather Than an Elastomeric Sealing Methodology", SPE 109791, Nov. 2007, 1-5.

(Continued)

*Primary Examiner*—William P Neuder
*Assistant Examiner*—Elizabeth C Gottlieb
(74) *Attorney, Agent, or Firm*—Steve Rosenblatt

(57) ABSTRACT

A series of screens with restrictors to equalize flow through base pipe perforations downstream or upstream of each restrictor features a valve member in the openings so that the screens are closed to flow for run in. Pressure can be developed within the base pipe for operation of downhole equipment below the screens such as a mud motor or in the screen liner such as a packer with no need for an internal string or wash pipe. The openings can be opened selectively when the associated equipment connected to the base pipes has been operated. The valve member can be actuated to open in a variety of ways such as applied pressure, temperature or a change in well fluid condition.

27 Claims, 11 Drawing Sheets

OTHER PUBLICATIONS

Andrews, Thad, et al., "Bidirectional Downhole Barrier Valve for Lubricator Applications", SPE 125083, Oct. 2009, 1-7.

Vachon, G., et al., "Production Optimization in ESP Completions Using Basic Intelligent-Well Technology", SPE 93617, Apr. 2005, 1-6.

Constantine, Jesse J., "Selective Production of Horizontal Openhole Completions Using ECP and Sliding Sleeve Technology", SPE 55618, May 1999, 1-5.

Fitzgerald, A., et al., "New High-Performance Completion Packer Selection and Deployment for Holstein and Mad Dog Deepwater Gulf of Mexico Projects", SPE 95729.

* cited by examiner

VALVE FOR EQUALIZER SAND SCREENS

FIELD OF THE INVENTION

The field of this invention relates to isolation valves for screens that allow the screens to be selectively closed to operate other equipment.

BACKGROUND OF THE INVENTION

In some long horizontal completions steps are taken to reduce the tendency of produced fluids to run along the outside of screens until reaching a necking down of the annular space outside the screened interval before making an attempt to go through the screen, usually on the uphole or heel end of the screen interval. To counteract this effect, the screen sections are provided with a non-perforated base pipe under the screen section that forces the fluid along an annular path between the base pipe and the screen until a restriction section is reached. The restriction section can be a spiral path that provides a flow restriction to the filtered fluid. After going through the spiral restriction section, the filtered fluid reaches the openings to go though the base pipe. This product is offered by Baker Oil Tools under the product name Equalizer Screen. A series of screens with the same or differing restrictions are arranged in an interval to distribute the incoming flow among all the screen sections by counteracting the tendency of the fluid to otherwise follow the path of least resistance and flow in the annular space outside all the screen sections until reaching the heel of a horizontal run and trying to go through the most uphole screen first.

It is desirable for a variety of reasons to keep the inflow openings in such screens closed until the screens are to be put in service. For one thing, if the inflow openings are kept closed there is no flow through the screens until they are to be put into service. Additionally, with the base pipe closed it can be pressurized so that equipment mounted on the lower end such as a mud motor to drive a bit can be installed and operated to bring the screens into the desired generally horizontal open hole completion for production. Additionally, hydraulic-set packers in the screen liner can be set without resorting to a wash pipe or inner string to isolate the packer inlet from what would otherwise be an open area at the screens.

While a possible solution is to plug the inflow openings with a rupture disc, the problem with that is that there is no assurance all the rupture discs will break at the same time. If even one rupture disc breaks early, the others will not break at all as all the developed pressure within the base pipes will dissipate through the opened rupture disc. Early attempts to deal with this issue can be seen in U.S. Pat. No. 5,425,424 and the cited patents therein to Zandmer.

What is needed is a technique that keeps the inflow passage closed until the screens need to be put into service while ensuring that all the screens will go into service when needed because the openings will go to the open position when needed.

The present invention relates to a valve design for the inflow openings in the screen sections that make up the screened interval that keep the screens closed for run in to prevent flow through them while at the same time allowing pressure to build up within the base pipes so that tools can be operated. When the applied pressure is relieved the valves can open so that the screens can become operative. These and other features of the present invention will be more readily appreciated by those skilled in the art from a review of the description of the preferred embodiment and the associated drawings with the understand that the full scope of the invention is indicated in the claims.

SUMMARY OF THE INVENTION

A series of screens with restrictors to equalize flow through base pipe perforations downstream or upstream of each restrictor features a valve member in the openings so that the screens are closed to flow for run in. Pressure can be developed within the base pipe for operation of downhole equipment below the screens such as a mud motor or in the screen liner such as a packer with no need for an internal string or wash pipe. The openings can be opened selectively when the associated equipment connected to the base pipes has been operated. The valve member can be actuated to open in a variety of ways such as applied pressure, temperature or a change in well fluid condition.

BRIEF DESCRIPTION OF THE DRAWINGS

FIG. 13 is an alternative embodiment shown in section during run in;

FIG. 16 is an alternative embodiment shown in section during run in;

DETAILED DESCRIPTION OF THE PREFERRED EMBODIMENT

Figure 1:
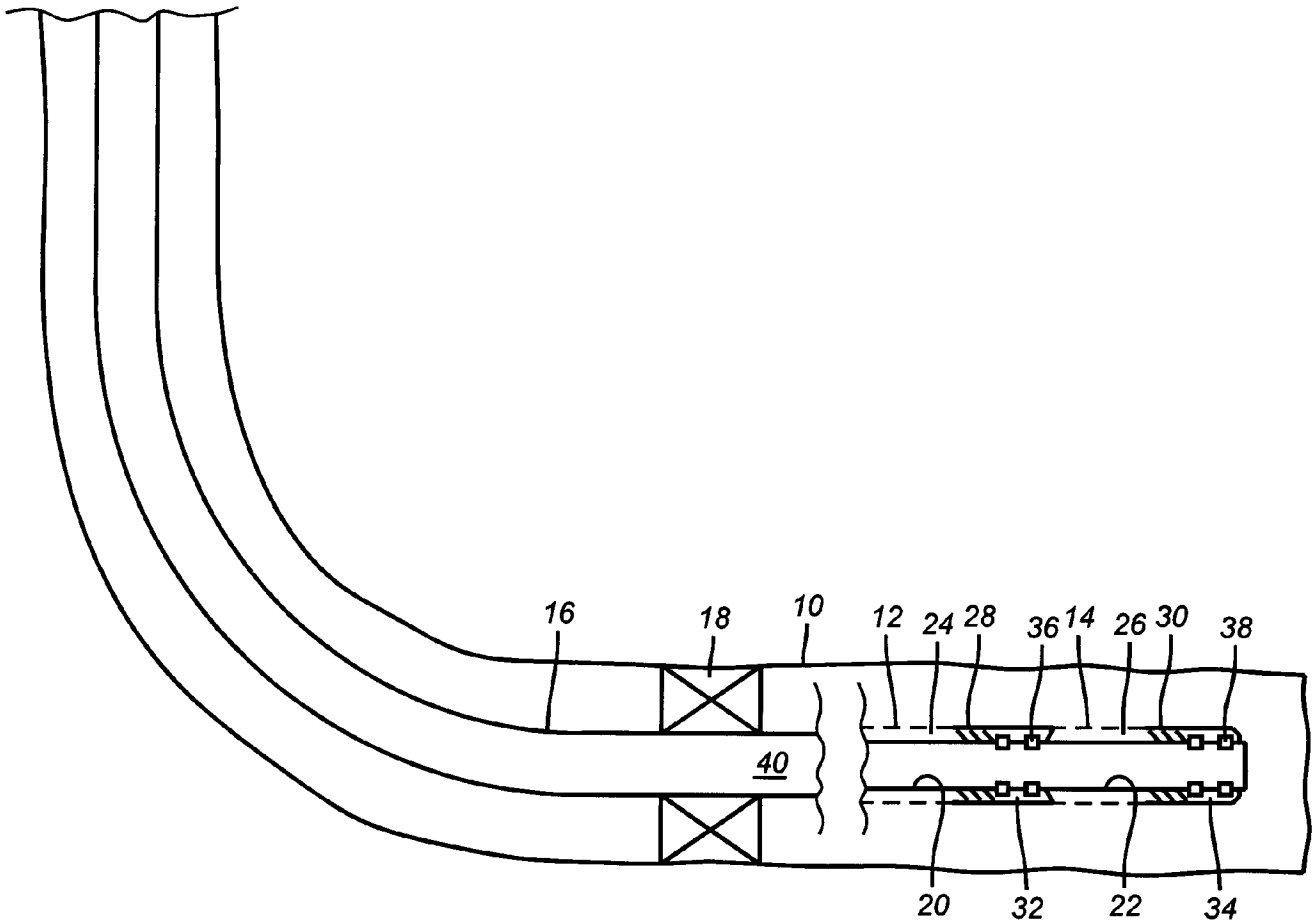
FIG. 1 is a section view of a horizontal run in a wellbore showing the screens that carry the valve of the present invention.

FIG. 1 illustrates a horizontal interval 10 that is uncased and has a series of Equalizer screens 12 and 14, for example connected to a production string 16. A packer 18 is connected to string 16. Base pipes 20 and 22 are solid. Annular spaces 24 and 26 lead to restrictors 28 and 30 respectively. These restrictors are essentially a spiral path whose dimensions determine resistance to the filtered fluid that has gotten through the screens 12 and 14. After passing through the restrictors 28 and 30, the filtered fluid enters annular spaces 32 or 34 to reach respectively the valves 36 and 38 that are a part of the present invention. When valves 36 and 38 are closed, pressure in passage 40 can be built up so that, for example, the packer 18 can be set. In other applications, the lower end can have a mud motor and drill bit attached so that drilling that brings the screens 12 and 14 into position in horizontal interval 10 can be accomplished and afterward the valves 36 and 38 can be operated to open so that fluid communication through screens 12 and 14 can begin into passage 40.

A preferred feature of the valves 36 or 38 is that they are run in closed and preferably locked in that position against opening. The valves move while remaining closed under increasing applied pressure. This feature allows internal pressure to build up in passage 40 to operate downhole tools, a few of which have been described above. Pressurizing also repositions the valves for subsequent opening. This can be configured in several ways. One way is to bias them so that removal of pressure the first time simply allows them all to open. Another way is to mount the valve members on a j-slot mechanism so that the pressure can be cycled off and on a predetermined amount of times before the valves go open. Another valve style altogether can be used so that the openings are blocked until a well condition changes so that the blocking material goes away. The well condition can be a change in temperature or pH that interacts with the blocking material to remove it. Here again, this latter technique is less preferred because it is not as simple to control the variables in the well. Additional, there is also the issue of the variability of the response of the valve material which could result in some openings being opened wide while others remain obstructed.

Figure 2:
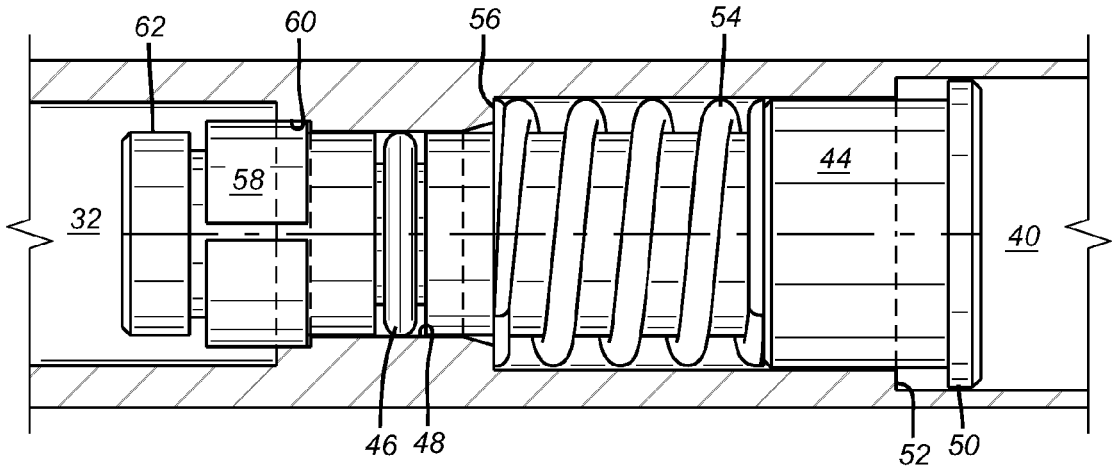
FIG. 2 shows a valve locked in the closed position for isolation of its respective the screen.
Figure 3:
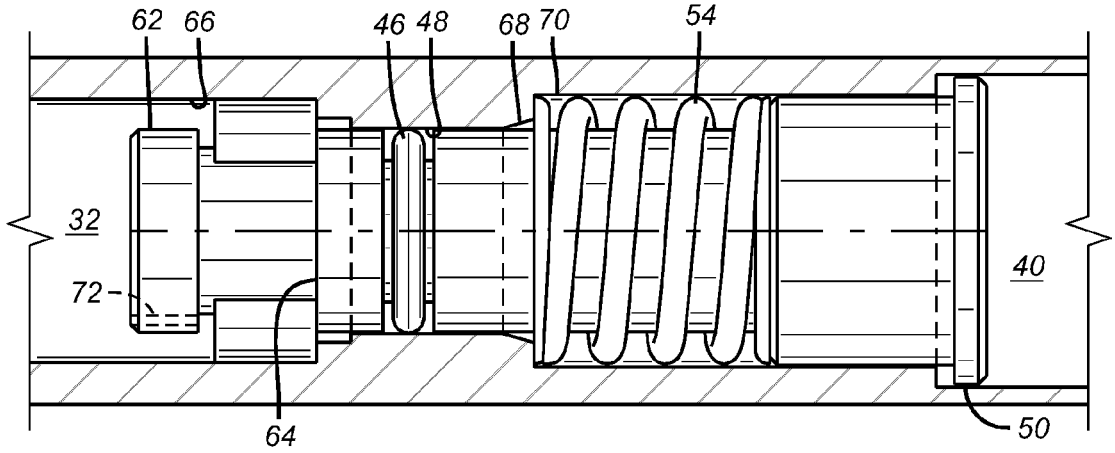
FIG. 3 is the view of FIG. 2 with pressure applied to release the lock while the valve remains closed until pressure is relieved.

A few of the preferred embodiments of valves such as 36 and 38 will now be described below. FIG. 2 illustrates a passage 40 to annulus 32 or 34 on the other end. Passage 40 is closed initially by plunger 44 that supports a seal 46 positioned in bore 48 of passage 40. Head 50 sees pressure built up in passage 40 and is limited in motion by surface 52 that surround passage 40. Spring 54 is supported by shoulder 56 to push the plunger 44 in the direction of passage 40. A c-ring 58 is held compressed in bore 60. In the compressed condition, the c-ring 58 will not allow bottom hub 62 to pass and this prevents spring 54 from moving seal 46 out of sealing position in bore 48. However, as shown in FIG. 3, with pressure from passage 40 applied to head 50, shoulder 64 pushed c-ring 58 out of bore 60 so that it can spring out into bore 66 so that hub 62 can clear through it but only after pressure on head 50 is reduced or removed. That lets spring 54 move plunger or valve member 44 enough to get seal 46 into taper 68 or bore 70 so that flow can commence in passage 40. At this time the plunger 44 can be pushed clear of passage 42 by spring 54 and the flowing fluid from annular space such as 32. Allowing the valve passage to open after applied pressure has been removed also prevents an undesirable pressure surge against the formation when the valves open, which may lead to production impairment. Alternatively, hub 62 can have a series of bores 72 and can be captured on bore 48 to retain the plunger 44 in passage 40 while still letting unhindered flow pass from the annular space such as 32 through the bores 72 and the now open passage 40.

Those skilled in the art will appreciate that while two screen sections are illustrated, additional sections could be used. Multiple valves may also be used in each screen joint. Additionally, instead of the one time pressurize and release operation shown in FIGS. 2 and 3, the c-ring 58 can be replaced with a j-slot mechanism between the plunger 44 and the passage 42 so that any number of desired pressure cycles could be applied to head 50 before the seal 46 is allowed to be displaced from bore 48. Use of head 50 creates a travel stop under pressure in passage 40 to prevent bottoming the spring 54 or pushing seal 46 out of the bore 38.

Figure 4:
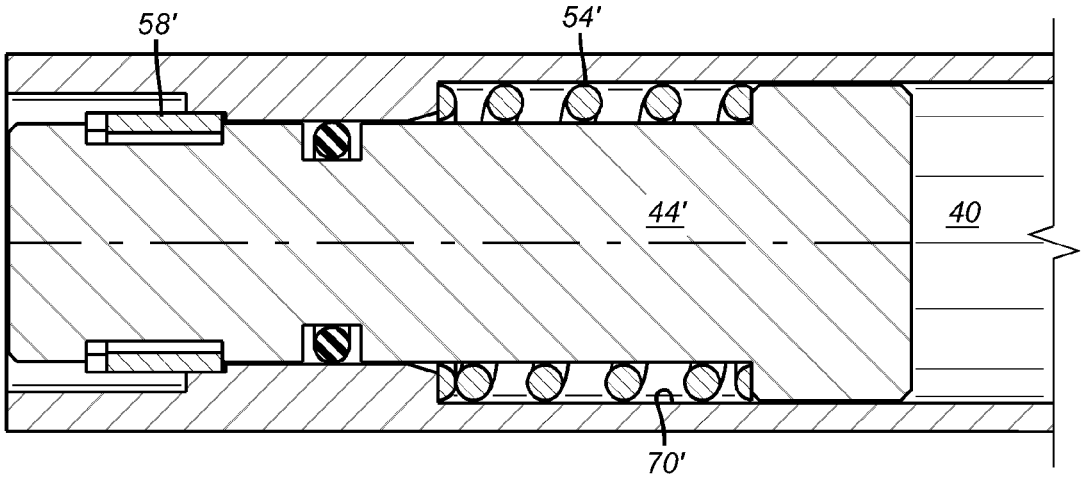
FIG. 4 is an alternative embodiment to the valve of FIG. 2 shown in the locked closed position.
Figure 5:
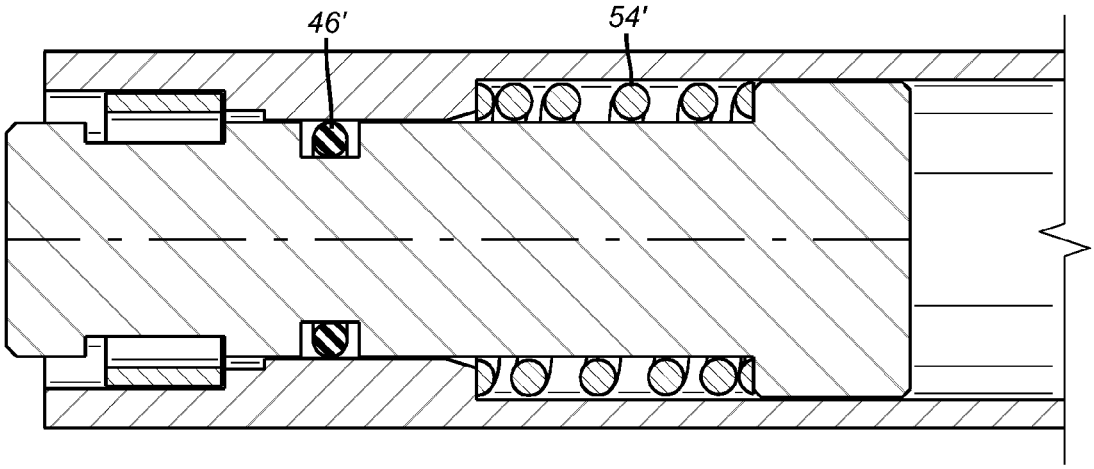
FIG. 5 is the valve of FIG. 4 unlocked but still held closed with applied pressure but in the position to spring open if pressure is removed.

FIGS. 4 and 5 are basically the same design as FIGS. 2 and 3 with the exception that head 50 is not there. This allows the plunger 44' to enter bore 70' when pressure from passage 40 is applied. Otherwise the operation is the same. This design allows the coils of spring 54' being pushed together to act as a travel stop for the plunger 44'.

Figure 6:
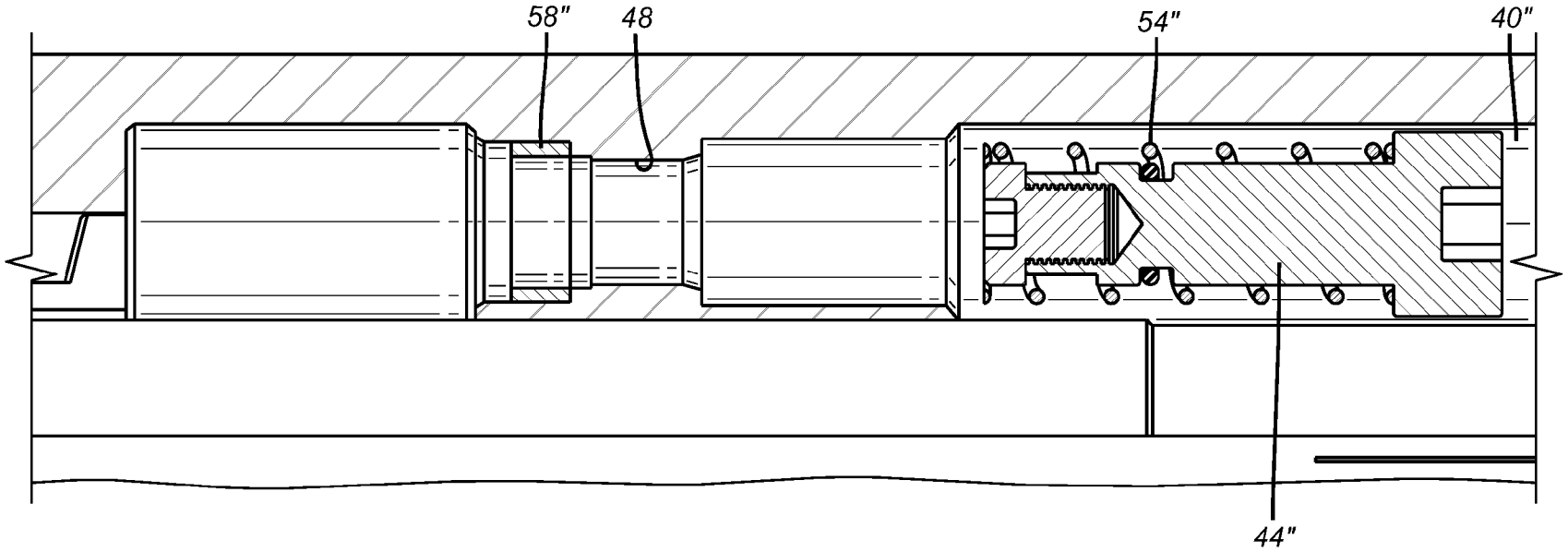
FIG. 6 shows the valve of FIG. 5 with pressure removed and the valve fully open.

FIG. 6 shows the embodiment of FIGS. 4 and 5 to illustrate what happens after the pressure has been removed after that position is reached. In essence, the spring 54 expands to open bore 48 and let flow through the valve.

Figure 7:
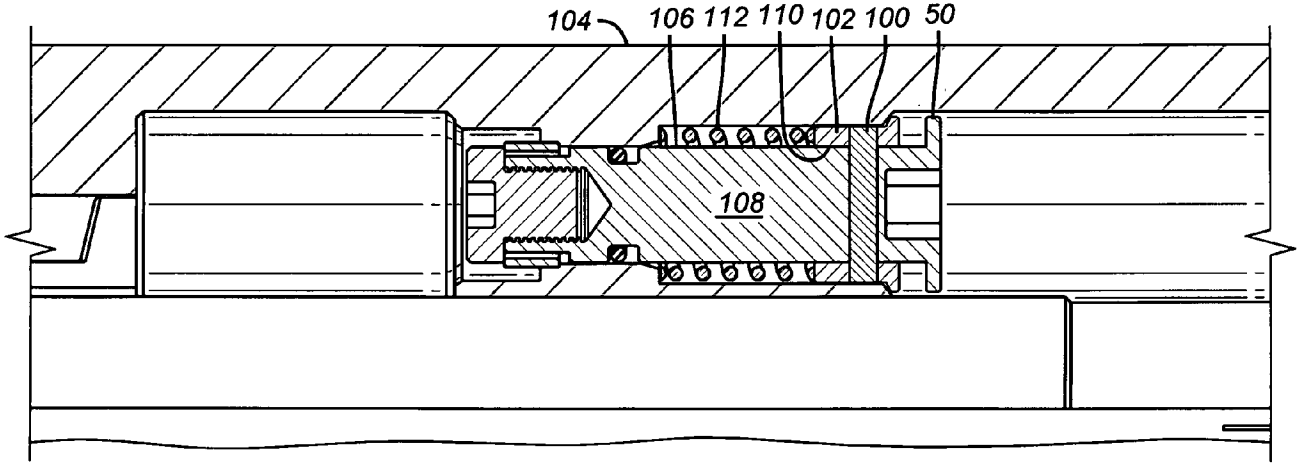
FIG. 7 is an alternative embodiment using a shear pin to allow cycles of pressure below a threshold from moving the valve member.
Figure 8:
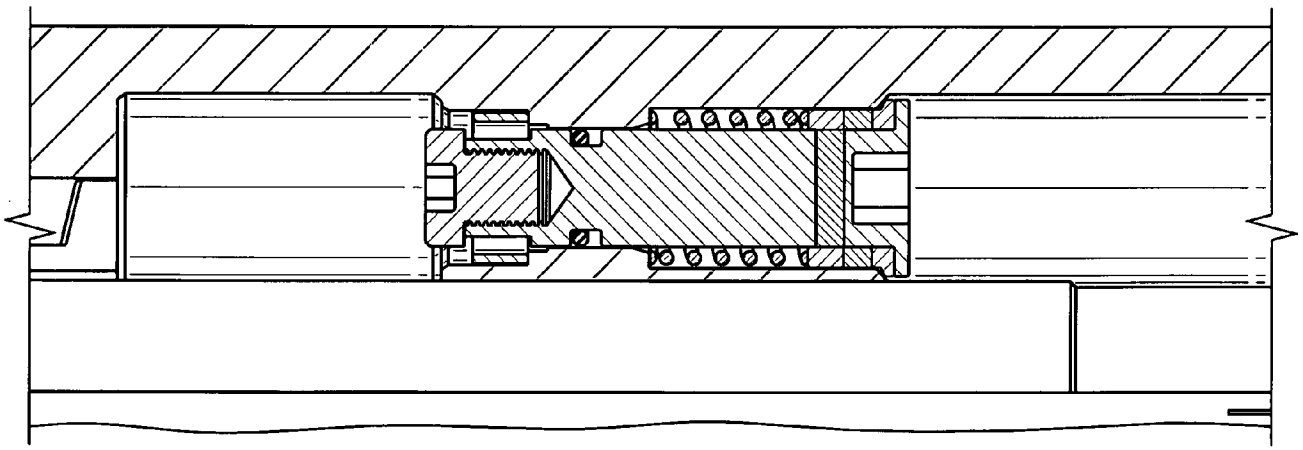
FIG. 8 is the embodiment of FIG. 7 armed to open if pressure is removed.

FIGS. 7 and 8 show another embodiment that adds a shear pin 100, to act as a restraining member, so that pressure below the break point of the shear pin 100 can be applied to the heads 50 in as many cycles as needed without any movement occurring. Pin 100 is retained by ring 102 that is slidably inserted into the housing 104. Preferably, each valve exposed to the tubing pressure can have a shear pin 100 but as seen in the other embodiments, such use is entirely optional. When it is desired to open the valves, the pressure is simply raised to a point where all the shear pins 100 or equivalent structures used will all be broken and at that point the operation continues in the same manner described above. It should be noted that the shear plane for pin 100 is at the interface of the outer surface 106 of piston 108 and the inner surface 110 of ring 102. When the pressure is relieved after the position of FIG. 8 is achieved, this configuration will prevent jagged surfaces in the shear plane from impeding the bias force of spring 112 on piston 108.

Figure 9:
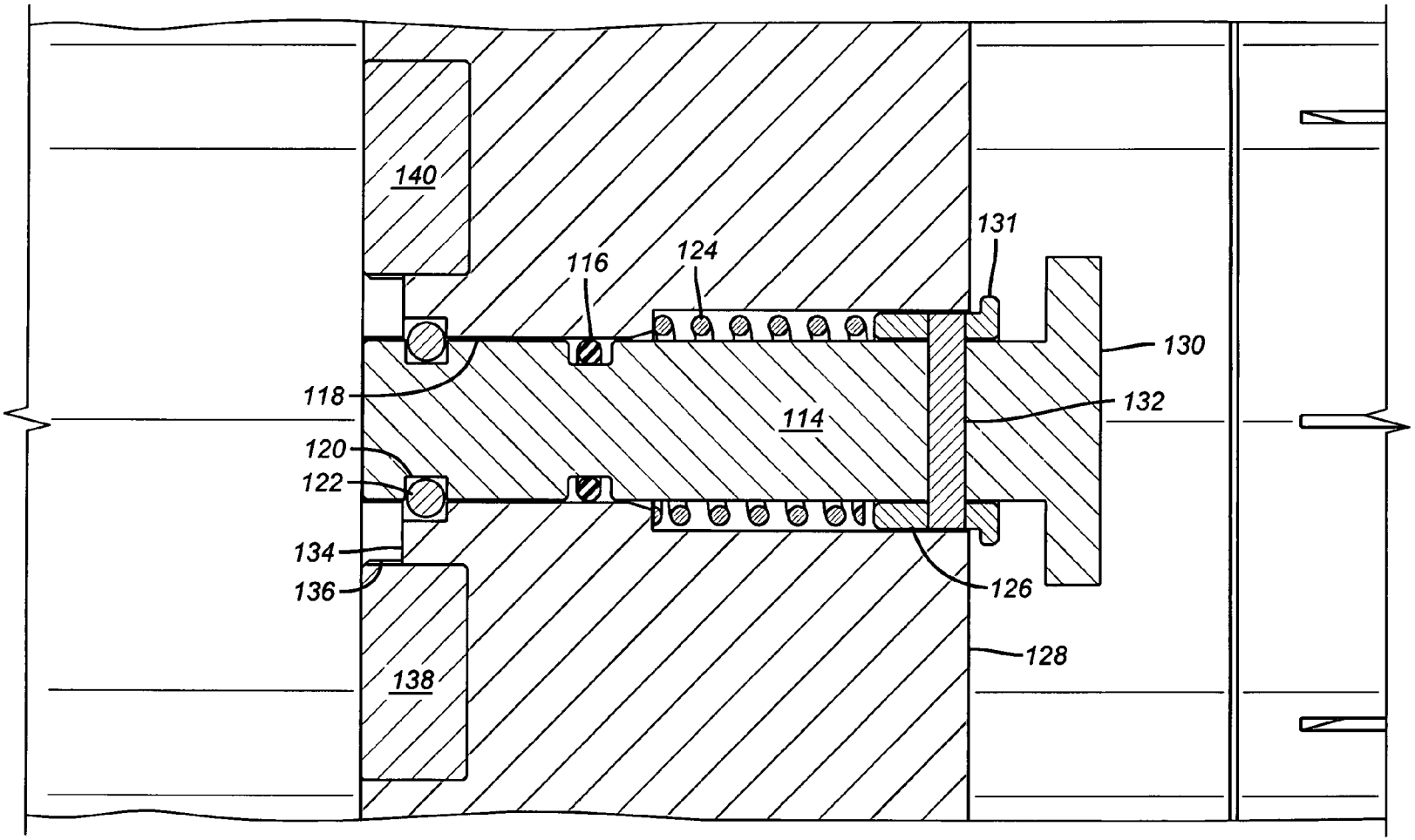
FIG. 9 is an alternative to the FIGS. 6-7 embodiment, in the run in position.
Figure 10:
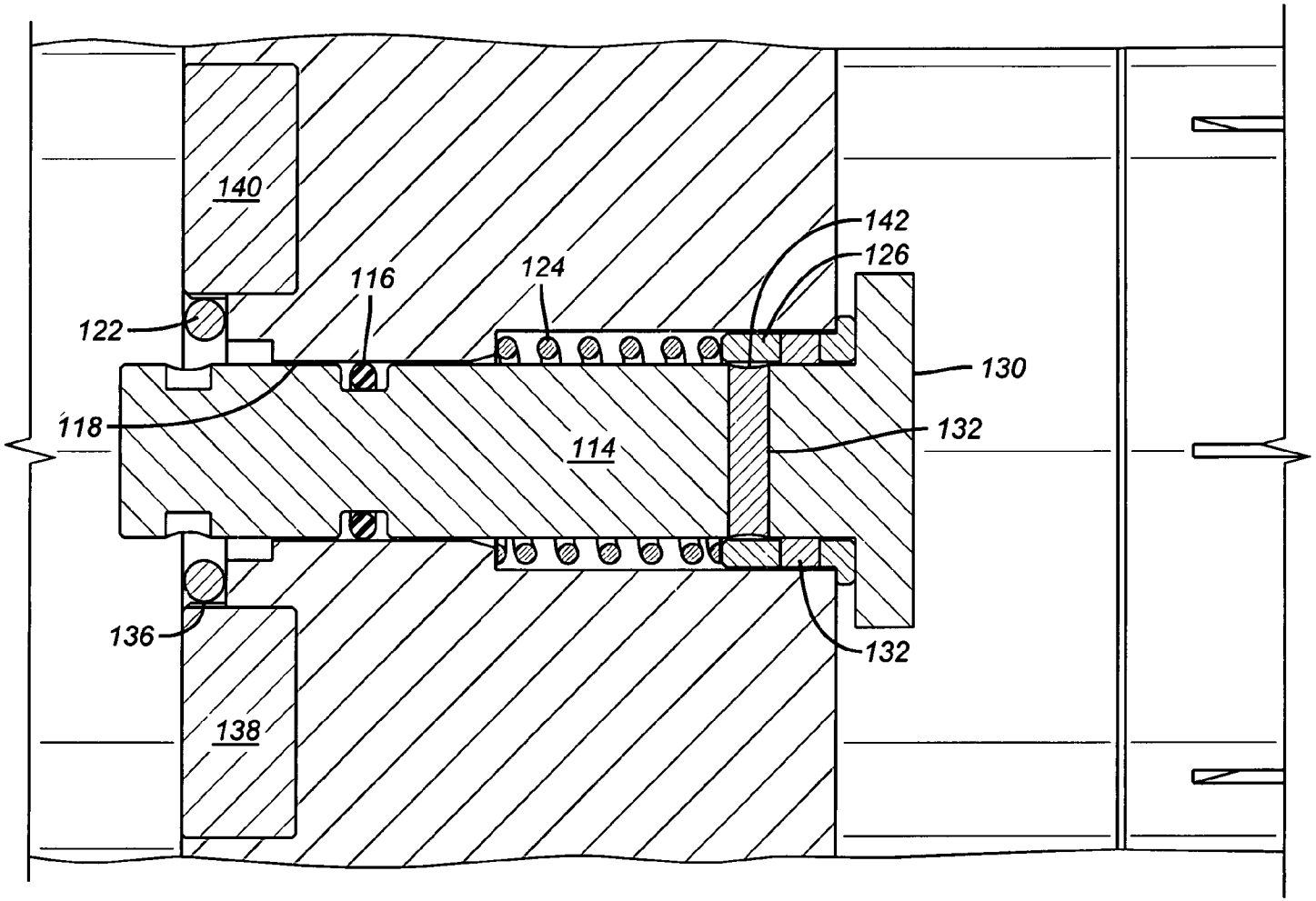
FIG. 10 is the view of FIG. 9 in the armed position.
Figure 11:
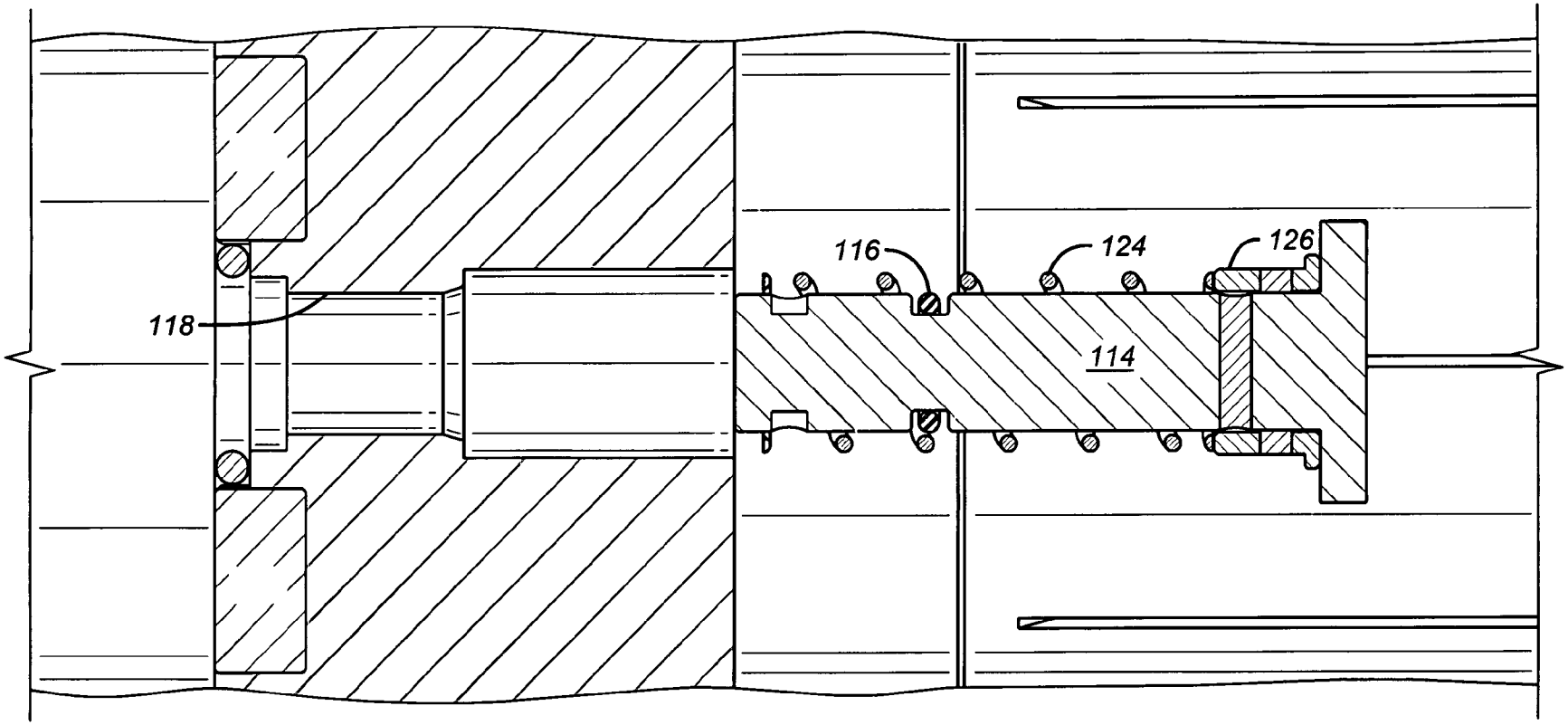
FIG. 11 is the view of FIG. 10 in the valve open position.
Figure 12:
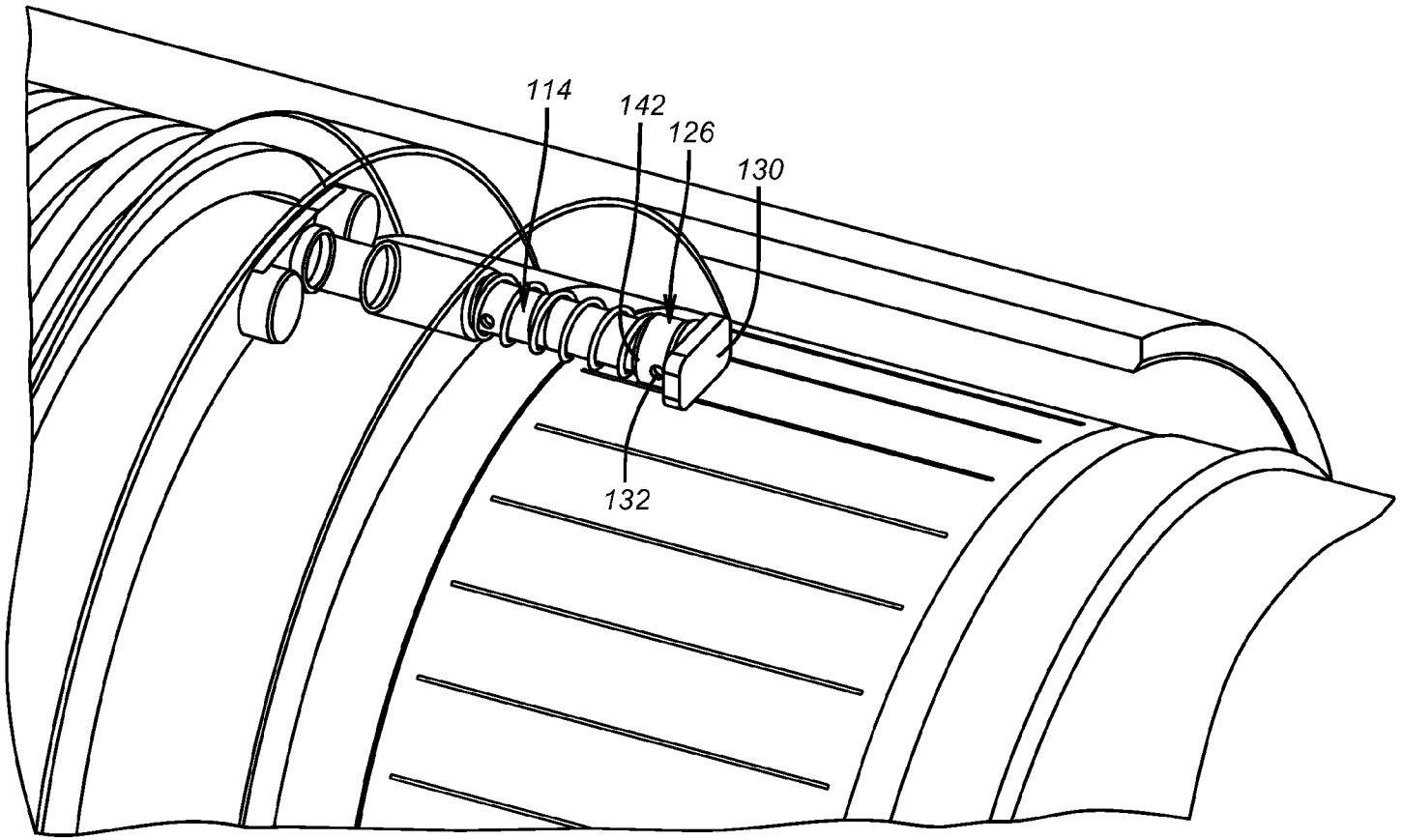
FIG. 12 is a perspective view of a piston end of the FIG. 9 embodiment.

FIG. 9 shows a piston 114 having a seal 116 blocking a passage 118 for run in. A groove 120 traps an object 122 to resist the bias imposed by spring 124 on pin retainer ring 126. Ring 126 is not secured to housing 128 but has a lip 131 that limits its travel into housing 128 in response to applied pressure on head 130. Pin 132 initially holds ring 126 to the piston 114. Object 122 prevents piston 114 from being propelled out of passage 118. This is because opposite to groove 120 for run in is a step 134 that opens into a larger groove 136. Magnets 138 and 140 attract the objects 122 as piston 114 shifts under pressure to align the objects 122 with groove 136. FIG. 10 shows this position that is achieved by applying and holding pressure on head 130. What has happened is that the shear pin 132 is sheared and groove 120 has shifted left to align with groove 136 so that the magnetic force attracts the objects 122, which can be ball bearings or other shapes and materials that also respond to magnetic force. At this FIG. 10 position, the removal of pressure on head 130 will allow spring 124 to propel both piston 114 and ring 126 out of passage 118 to the point where seal 116 is out of passage 118. This position is shown in FIG. 11. FIG. 12 shows a perspective view of piston 114 showing a rectangular shape of head 130 as one way to limit its rotation about its own axis, which maintains alignment with the objects 122 and magnets 138. The important thing to note on this embodiment is that the shear surface 142 (which is actually in the shape of a cylinder) where pin 132 is sheared is not the surface where subsequent relative movement occurs to eject piston 114 from passage 118. Instead, ring 126 moves with piston 114 so as to eliminate any resistance to relative movement that can occur at the shear surface 142 had the ring 126 been secured to the housing 128. The invention envisions a variety of ways to temporarily retain the piston 114 to get the result that the shear surface for a pin or equivalent restraining device 132 is not the sliding surface for ejection of the piston 114.

Figure 13:
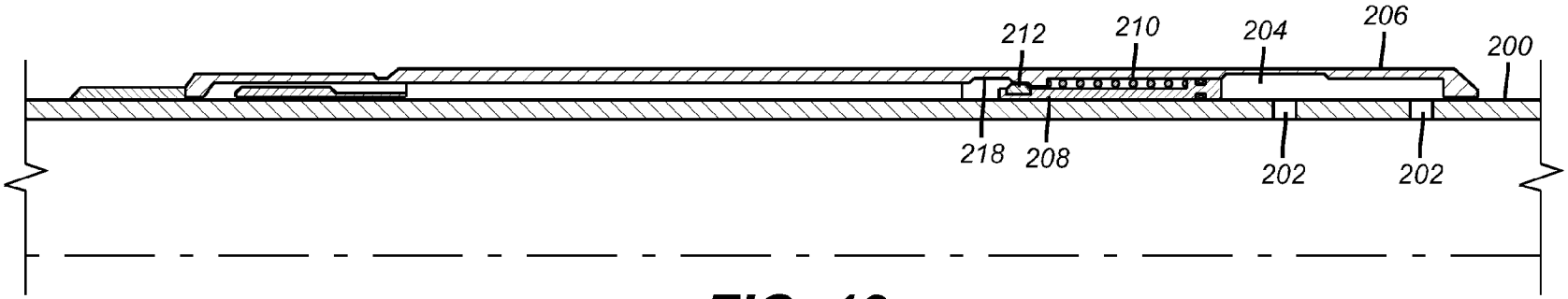
Figure 14:
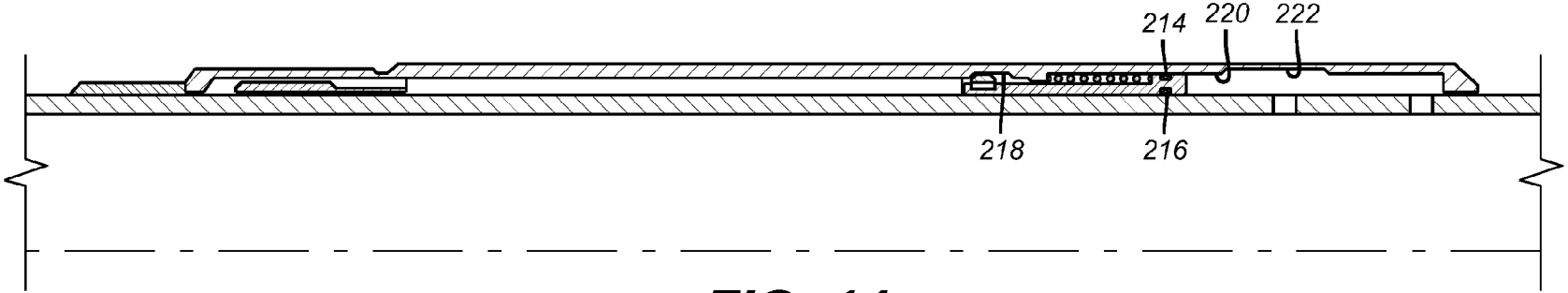
FIG. 14 is the view of FIG. 13 in the armed position.
Figure 15:
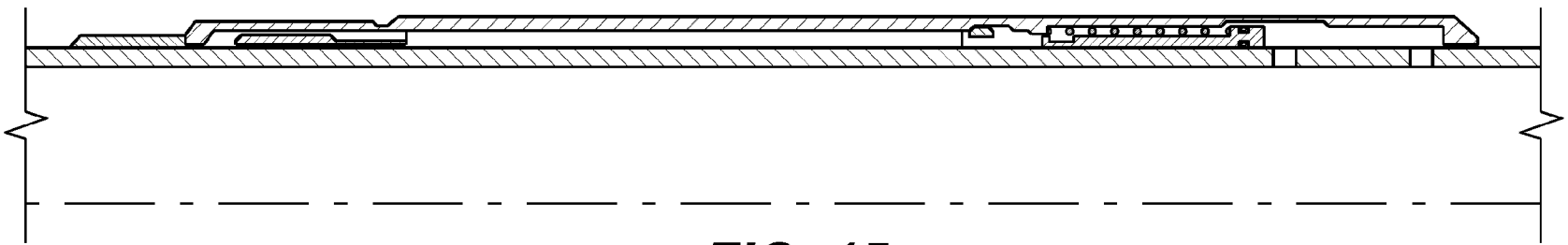
FIG. 15 is the view of FIG. 14 in the open position.

In FIG. 13 base pipe 200 has openings 202 into annular space 204 defined by outer sleeve 206. A piston 208 is biased by a spring 210 but initially a snap ring 212 keeps piston 208 from moving in the direction of the bias. Piston 208 has seals 214 and 216 so that upon pressure delivered through openings 202 the piston 208 is able to translate in the direction to compress spring 210. In the FIG. 14 position, the snap ring has snapped outwardly into a groove 218 so that it no longer interacts with the piston 208. No flow can get by the piston 208 and hence through the screen (not shown in these figures) because even in the FIG. 14 position with continued pressure applied through ports 202, the piston seals 214 and 216 are still in the narrow portion 220 defined by outer sleeve 206. However, when pressure through ports 202 is relieved, spring 210 can now bias the piston 208 into the larger diameter portion 222 of outer sleeve 206 so that flow can occur around seals 214 and 216. This open position is shown in FIG. 15. It should be noted that in this embodiment one end of spring 210 bears on the outer housing 206 while the other bears on the piston 208.

Figure 16:
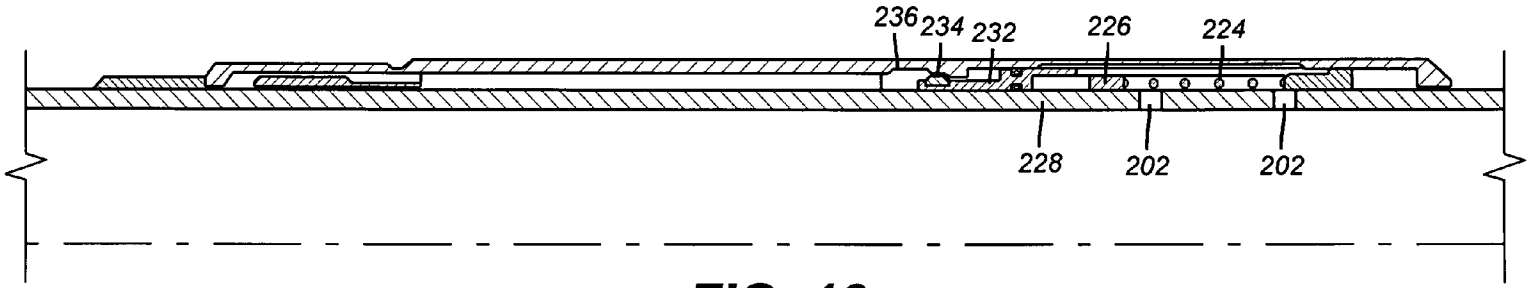
Figure 17:
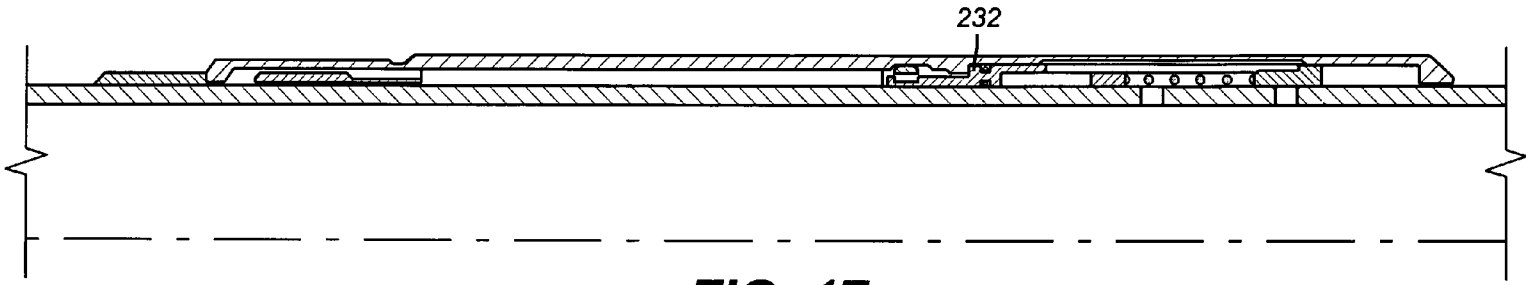
FIG. 17 is the view of FIG. 16 in the armed position.
Figure 18:
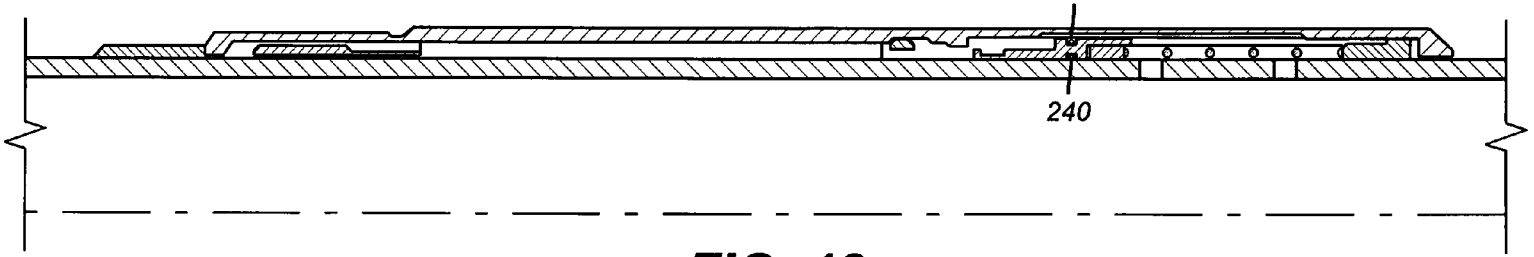
FIG. 18 is the view of FIG. 17 in the open position.

In FIG. 16 spring 224 bears on lug 226 attached to the base pipe 228. Pressure through openings 202 pushes piston 232 in a direction that compresses spring 224. At that time the snap ring 234 jumps out into groove 236 and as long as pressure is held in ports 202 there will be no flow past the piston 232. This is the view of FIG. 17. When pressure is relieved, the spring 224 pushes the piston 232 so that flow can bypass piston seals 238 and 240 as shown in FIG. 18. The alternative in FIGS. 13-15 operates the same way as the alternative in FIGS. 16-18 except the spring support location. The FIGS. 16-18 embodiment allows for a bigger spring using the same outer sleeve dimension.

The present invention allows equipment needing pressure to be operated without a wash pipe or an inner string while ensuring the openings open up when needed to allow proper screening of the produced fluids in the interval. When pressure is let up, either the first time, after a pre-determined pressure level is applied to activate a shear device or after sufficient cycles, the valves will be biased to open. Each valve works independently of the others so that problems in the past with a series of rupture discs is avoided. Since applied pressure is uniform, its removal in the presence of a biasing member such as a spring results in the Valves going to the open position independently.

Alternatives to these preferred designs for an application for equalizing screens are also contemplated. This can be a material such as a plug that is threaded or otherwise secured in the openings and that goes away in response to well conditions such as temperature or well fluid properties. These alternatives feature somewhat less control over the process of opening all the openings preferably at the same time but presents a next best alternative to the preferred embodiments that use pressure actuated valves that open in one or more cycles of pressure.

The above description is illustrative of the preferred embodiment and many modifications may be made by those skilled in the art without departing from the invention whose scope is to be determined from the literal and equivalent scope of the claims below.

We claim:

1. A flow communication assembly for multiple spaced locations to a passage through a tubular, comprising:

a tubular string comprising a plurality of wall openings leading to a passage therein and each selectively obstructed by a valve that further comprises:

a valve member in fluid communication with said passage in said tubular string that is disposed in a valve housing flow path substantially outside said passage and initially movable within said flow path in response to applied pressure from the tubular string while holding said applied pressure in the tubular string, said valve member is removed from said flow path, upon removal of applied pressure, sufficiently that flow from said flow path into said passage of said string does not go through said valve member.

2. The assembly of claim 1, wherein:

said openings remain closed until pressure is removed from the tubular string.

3. The assembly of claim 2, wherein:

said openings remain closed until pressure is applied and removed more than one time.

4. The assembly of claim 1, wherein:

said valve member comprises a biasing device urging it to move to a position to allow flow through the opening where it is mounted.

5. The assembly of claim 4, wherein:

said valve member comprises a lock to selectively prevent the biasing device from moving the valve member.

6. The assembly of claim 5, wherein:

said valve member is movable in response to applied pressure from the tubular string against the force of said biasing device.

7. The assembly of claim 6, wherein:

said lock is defeated by movement of said valve member against the force of said biasing device.

8. The assembly of claim 7, wherein:

said lock retains potential energy in a first position and releases said energy to change its dimension when moved to a second position responsive to applied pressure from the tubular string on said valve member.

9. The assembly of claim 8, wherein:

said lock comprises a split ring that is compressed when preventing valve member movement toward allowing flow through a respective opening and that is expanded into an adjacent larger bore in said opening.

10. The assembly of claim 7, wherein:

at least one retaining member prevents initial movement of said valve member until a predetermined pressure is initially applied, said retaining member extending through said valve member and into a support ring.

11. The assembly of claim 10, wherein:

initial movement of said valve member against the force of said biasing device shears said retaining member along a shear surface between said valve member and said support ring, whereupon removal of pressure on the valve member allows said biasing device to push said valve member with said support ring from their respective opening.

12. The assembly of claim 10, wherein:

initial movement of said valve member positions said lock in an enlarged zone to allow it to release said valve member.

13. The assembly of claim 1, wherein:

said valve member comprises at least one seal movable between a smaller and a larger bore in a respective opening to define the closed and open positions of said valve member.

14. The assembly of claim 13, wherein:

said seal remains in the smaller bore responsive to applied pressure from said tubular string to said valve member to retain said applied pressure.

15. The assembly of claim 14, wherein:

said valve member comprises a lock to selectively prevent movement of said seal into said larger bore.

16. The assembly of claim 15, wherein:

said valve member moves in a first direction responsive to applied pressure from said tubular string to defeat said lock whereupon movement of said valve member in a second and opposite direction a predetermined distance puts said seal in said larger bore.

17. The assembly of claim 16, wherein:

initial movement of said valve member in said second direction allows flow through said opening.

18. The assembly of claim 17, wherein:

said valve member comprises a biasing member urging it to move in said second direction.

19. The assembly of claim 18, wherein:

said lock is translated by said valve member moving in response to pressure from said tubular string to allow it to change from a first to a second dimension;

said lock preventing said seal from entering said larger bore when in said first dimension.

20. The assembly of claim 19, wherein:

said lock, when in said second dimension, allows said biasing member to move said valve member in said second direction until said seal moves into said larger bore.

21. The assembly of claim 18, wherein:

said lock is translated by said valve member moving in response to pressure from said tubular string to allow it to change from a first to a second radial position;

said lock preventing said seal from entering said larger bore when in said first radial position.

22. The assembly of claim 16, wherein:

a predetermined number of cycles of movement in said first and second directions need to occur before said seal can move into said larger bore.

23. The assembly of claim 22, wherein:

said valve member is retained in said opening by a j-slot mechanism.

24. The assembly of claim 1, further comprising:

a pressure operated downhole tool in flow communication with said tubular string and operable by applied pressure in said string with all said valve members pressurized and keeping said openings closed, whereupon removal of said pressure the valve member in each opening is moved to a position allowing flow through the opening.

25. The assembly of claim 1, wherein:

said valve member comprises a retaining member that holds its position against pressure that is below a predetermined threshold pressure.

26. A flow communication assembly for multiple spaced locations through a tubular, comprising:

a tubular string comprising a plurality of openings each selectively obstructed by a valve that further comprises:

a valve member in fluid communication with said tubular string that is movable in response to applied pressure from the tubular string while holding said applied pressure in the tubular string;

said valve member comprises a biasing device urging it to move to a position to allow flow through the opening where it is mounted;

said valve member comprises a lock to selectively prevent the biasing device from moving the valve member;

said valve member is movable in response to applied pressure from the tubular string against the force of said biasing device;

said lock is defeated by movement of said valve member against the force of said biasing device;

at least one retaining member prevents initial movement of said valve member until a predetermined pressure is initially applied, said retaining member extending through said valve member and into a support ring;

initial movement of said valve member positions said lock in an enlarged zone to allow it to release said valve member;

said lock comprises a magnetic object that is drawn away from said valve member after initial movement of said valve member by at least one magnet spaced from said valve member.

27. A flow communication assembly for multiple spaced locations through a tubular, comprising:

a tubular string comprising a plurality of openings each selectively obstructed by a valve that further comprises:

a valve member in fluid communication with said tubular string that is movable in response to applied pressure from the tubular string while holding said applied pressure in the tubular string;

said valve member comprises at least one seal movable between a smaller and a larger bore in a respective opening to define the closed and open positions of said valve member;

said valve member comprises a lock to selectively prevent movement of said seal into said larger bore;

said valve member moves in a first direction responsive to applied pressure from said tubular string to defeat said lock whereupon movement of said valve member in a second and opposite direction a predetermined distance puts said seal in said larger bore;

initial movement of said valve member in said second direction allows flow through said opening;

said valve member comprises a biasing member urging it to move in said second direction;

said lock is translated by said valve member moving in response to pressure from said tubular string to allow it to change from a first to a second radial position;

said lock preventing said seal from entering said larger bore when in said first radial position said lock, when in said second radial position, allows said biasing member to move said valve member in said second direction until said seal moves into said larger bore;

said lock moved to said second radial position by a magnetic force.

* * * * *